US008735705B1

(12) United States Patent
Chen

(10) Patent No.: US 8,735,705 B1
(45) Date of Patent: May 27, 2014

(54) DRUM BEATING APPARATUS

(71) Applicant: Kuo-Chang Chen, Taichung (TW)

(72) Inventor: Kuo-Chang Chen, Taichung (TW)

( * ) Notice: Subject to any disclaimer, the term of this patent is extended or adjusted under 35 U.S.C. 154(b) by 0 days.

(21) Appl. No.: 13/763,684

(22) Filed: Feb. 10, 2013

(51) Int. Cl.
*G10D 13/02* (2006.01)
*G10D 13/00* (2006.01)

(52) U.S. Cl.
CPC ..... *G10D 13/006* (2013.01)
USPC ..... 84/422.1

(58) Field of Classification Search
CPC ..... G10D 13/006
USPC ..... 84/422.1
See application file for complete search history.

(56) References Cited

U.S. PATENT DOCUMENTS

| | | | | |
|---|---|---|---|---|
| 4,198,894 | A * | 4/1980 | Della-Porta et al. | 84/422.1 |
| 6,924,422 | B2 * | 8/2005 | Wise | 84/422.1 |
| 7,541,531 | B1 * | 6/2009 | Jacobson | 84/422.1 |
| 7,897,858 | B1 * | 3/2011 | Liao | 84/422.1 |
| 2007/0044637 | A1 * | 3/2007 | Kjellfren | 84/422.1 |

* cited by examiner

*Primary Examiner* — Robert W Horn

(57) ABSTRACT

A drum beating apparatus is provided. A base includes a bottom plate and a first post disposed on the bottom plate, and a connecting portion is arranged on the first post. An axle is coupled to the first post and rotatable around an axis of the axle. A linking assembly has corresponding first and second ends, a rod element which is connected between the first and second ends and an elastic element. The first end is pivoted to one end of the axle, the rod element is disposed through the connecting portion, and the elastic element is disposed around the rod element and located between the second end and the connecting portion. One end of a pedal is swingably coupled to one end of the bottom plate, and the other end of the pedal is co-movably connected to the axle.

11 Claims, 6 Drawing Sheets

DRUM BEATING APPARATUS

BACKGROUND OF THE INVENTION

1. Field of the Invention

The present invention relates to a drum beating apparatus.

2. Description of the Prior Art

In some cases, pedal assembly of a percussion instrument may have plurality of pedal units and plurality of striking portions. As such, a linkage is necessary for the pedal assembly. The linkage connects the pedal unit to the striking portion so as to achieve a rotational operative relationship between the pedal unit and the striking portion.

For example, US20110146475 and US20070044637 disclose an apparatus which is similar to the above-mentioned one. A spring is disposed between an axle and a connecting portion of a linking rod, so that the drumstick can beat as the pedal is depressed, and the linking rod, the pedal and the drumstick can return to their respective original position after the pedal is released from depression.

However, in the above disclosures, since the spring is disposed in an improper position between the axle and the connecting portion of the linking rod, the drumstick can oscillate or sway to and fro for a long period due to its inertia after an operation. As a result, the operation of the drumstick is very unstable, unsmooth and imprecise, so that the above conventional drum percussion instruments each have defects to be improved.

The present invention is, therefore, arisen to obviate or at least mitigate the above mentioned disadvantages.

SUMMARY OF THE INVENTION

The main object of the present invention is to provide a drum beating apparatus which can effectively improve the problem of oscillation or sway for a long period due to the element inertia after an operation; the operation and movement thereof are much more stable, smooth and precise; and it is easy to assemble, disassemble, change and store.

To achieve the above and other objects, a drum beating apparatus of the present invention includes a base, an axle, a linking assembly and a pedal. The base includes a bottom plate and a first post substantially axially disposed on the bottom plate, and a connecting portion is arranged radially on the first post. The axle is coupled to the first post and rotatable around an axis of the axle. The linking assembly has corresponding first and second ends, a rod element which is connected between the first and second ends and an elastic element. The first end is pivoted to one end of the axle, the rod element is disposed through the connecting portion, the connecting portion is located between the first end and the second end, and the elastic element is disposed around the rod element and located between the second end and the connecting portion. One end of the pedal is swingably coupled to one end of the bottom plate, and the other end of the pedal is co-movably connected to the axle. As the pedal swings, the axle is driven by the pedal to rotate around the axis and the linking assembly is co-movably driven simultaneously to swing.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
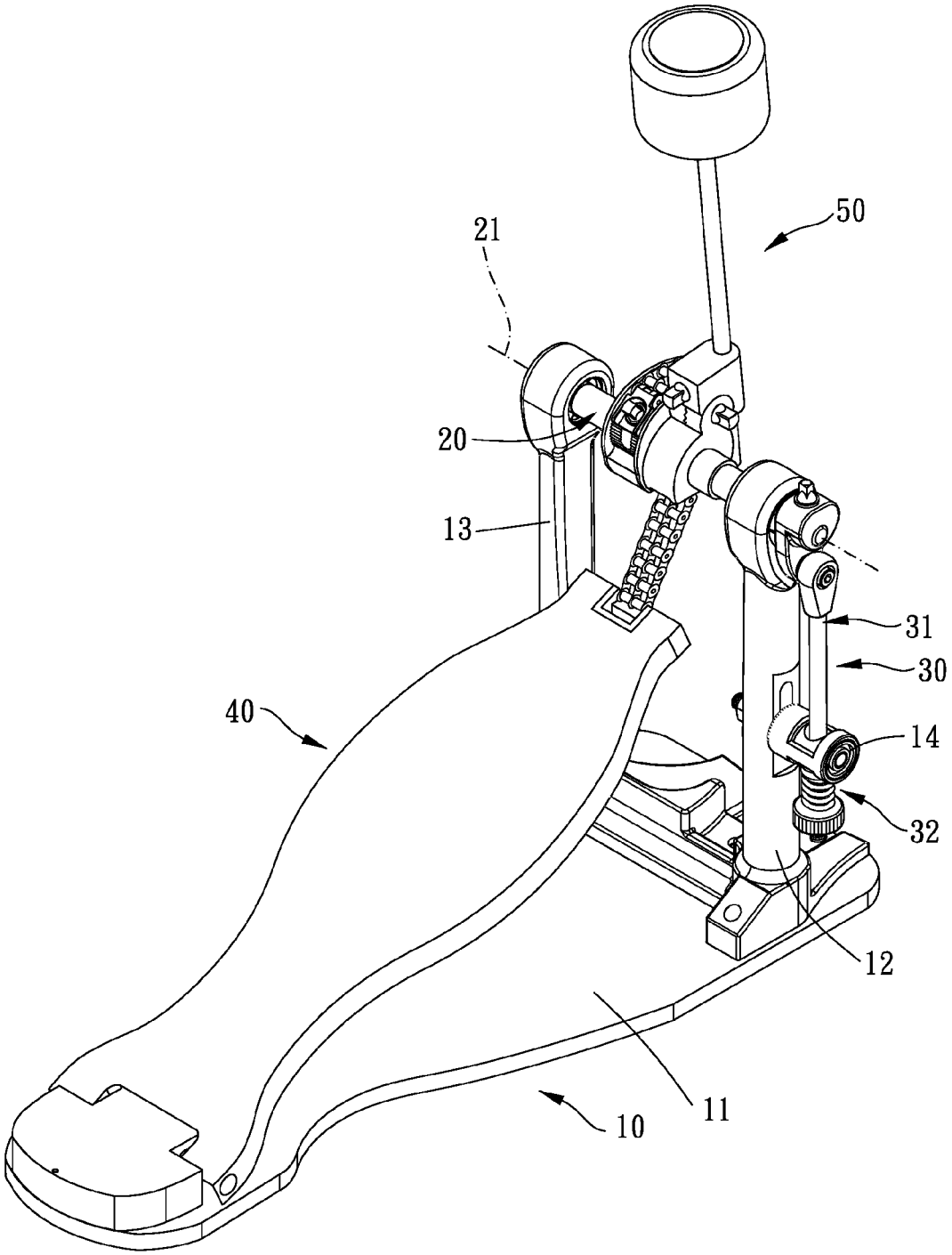
FIG. 1 is a perspective view of a first embodiment of the present invention.
Figure 2:
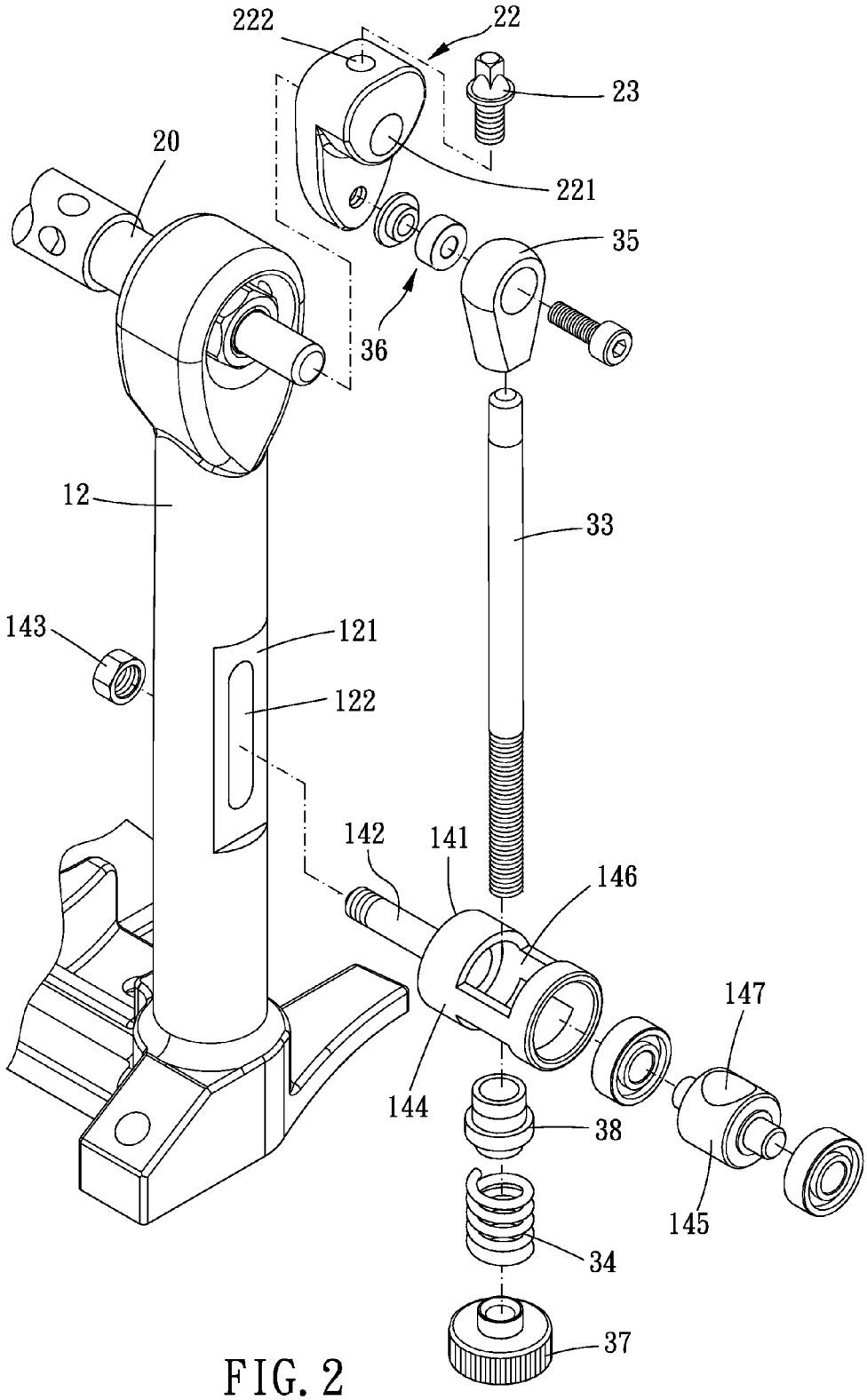
FIG. 2 is a breakdown drawing of the first embodiment of the present invention.

As shown in FIGS. 1 to 4, a drum beating apparatus 1 of a first embodiment according to the present invention is provided. The drum beating apparatus includes a base 10, an axle 20, a linking assembly 30 and a pedal 40.

The base 10 includes a bottom plate 11, a first post 12 substantially axially (but not limited to be) disposed on the bottom plate 11 and a second post 13. Specifically, the first post 12 and the second post 13 are correspondingly substantially axially disposed on two frontal sides of the bottom plate 11. It is noted that the first post 12 and the second post 13 may be interchanged in their position. The first post 12 or/and the second post 13 are preferably adjustable relative to the bottom plate 11. The bottom plate 11 may be provided with plural installation portions located in different positions such as threaded holes, and the first post 12 or/and the second post 13 may be fixed to the bottom plate 11 by screwing or via a quick-release mechanism, so that the first post 12 or/and the second post 13 can be arranged in required positions according to various requirements. It is noted that a linkage may be connected between the respective bottom ends or mid portions of the first post 12 and the second post 13, thus enhancing and stabilizing the structure. The linkage, the first post 12 and the second post 13 may be integrally formed or detachably connected (easy to be assembled, disassembled, changed and stored). In an alternative embodiment, the base 10 may be arranged merely with the first post 12, and the axle 20 is pivoted to the first post 12.

A connecting portion 14 is arranged radially on the first post 12. Preferably, the connecting portion 14 is adjustably coupled radially to the first post 12. Specifically, a circumferential surface of the first post 12 has a radially-extending first abutted region 121, and the first abutted region 121 is formed with a radially-extending through slot 122. The first abutted region 121 may be a plane recessed radially on two sides of the first post 12. The connecting portion 14 has a second abutted region 141 corresponding to the first abutted region 121, a rod portion 142 extending from the second abutted region 141 and a first fixation element 143. The rod portion 142 is disposed through the through slot 122, the first fixation element 143 is releasably coupled to a distal end of the rod portion 142, and the second abutted region 141 is abutted against the first abutted region 121, so that the connecting portion 14 can be firmly fixed to the first post 12. It is noted that the first post 12 may be formed with a generally round through hole radially, for example, the round through hole has a diameter lightly smaller than that of the rod portion 142 so that the rod portion 142 can be disposed through the round through hole but is substantially radially-unmovable relative to the first post 12, and the rod portion 142 can thereby be firmly fixed.

In this embodiment, the first abutted region 121 and the second abutted region 141 are both plane, such that the first abutted region 121 and the second abutted region 141 will not move and swing relatively after they are abutted against each other. However, the first abutted region 121 and the second abutted region 141 may have complementary structures such as recess/protrusion or structures which can fixedly engage with each other. The connecting portion 14 further includes a cannular portion 144 and a rotatable element 145 rotatably disposed in the cannular portion 144. A sidewall of the cannular portion 144 is formed with two corresponding openings 146, and the rotatable element 145 is formed with a through hole 147. It is noted that the connecting portion 14 is not limited to as the aforementioned structures, and any structure which can be adapted for rotation and swing of the linking assembly 30 thereabout may be employed.

The axle 20 is coupled to the first post 12 and the second post 13, and rotatable around an axis 21 of the axle 20. Specifically, two ends of the axle 20 are rotatably disposed axially to the first post 12 and the second post 13. One end (the right end in this embodiment) of the axle 20 is disposed through the first post 12 and protrusive from the first post 12 for a distance. A connecting element 22 is detachably coupled to the right end of the axle 20, the connecting element 22 and the axle 20 are in a rotational cooperative relationship. Specifically, the connecting element 22 includes a bore 221 disposed around the axle 20 and a penetrating hole 222 communicated with the bore 221. A second fixation element 23 is disposed through the penetrating hole 222 and releasably abutted against the axle 20 so that the connecting element 22 is fixed to the axle 20. Through the aforementioned structure, the connecting element 22 can be selectively to be adjustably fixed in a required position, thus facilitating to assemble, disassemble and change parts of the drum beating apparatus.

The linking assembly 30 has corresponding first end 31 and second end 32, a rod element 33 which is connected to the first end 31 between the second end 32, and an elastic element 34. The first end 31 is pivoted to the connecting element 22, and more specifically, the first end 31 is pivoted to the right end of the axle 20 via the connecting element 22. The rod element 33 is disposed through the connecting portion 14, and the connecting portion 14 is located between the first end 31 and the second end 32. More specifically, a circumferential dimension of each opening 146 of the cannular portion 144 is greater than a radial dimension of the rod element 33. The rod element 33 is disposed through the two openings 146 and the through hole 147, and each opening 146 can provide a space for the swing of the rod element 33 circumferentially relative to the cannular portion 144.

The elastic element 34, such as but not limited to coil spring, is disposed around the rod element 33 and located between the second end 32 and the connecting portion 14. The linking assembly 30 may further include a head portion 35 coupled to one end of the rod element 33 and a pivoting assembly 36 for the pivot of the head portion 35 to the connecting element 22, and the pivoting assembly 36 is detachably pivoted to the connecting element 22 and the head portion 35. In this embodiment, the pivoting assembly 36 is not coaxial with the axis 21 and rotatable about the axis 21.

In this embodiment, the linking assembly 30 further includes an adjustable element 37 adjustably disposed at the second end 32, and the elastic element 34 is located between the adjustable element 37 and the connecting portion 14. More specifically, a lower end of the rod element 33 is formed with a threaded section, the adjustable element 37 is screwed to the threaded section and position-adjustable along the rod element 33 via being rotated, and the depressed deformation of the elastic element 34 can be controlled. Preferably, the linking assembly 30 further includes an insert 38 located between the elastic element 34 and the rotatable element 145. More specifically, the insert 38 has an enlarged circumferential flange formed at a middle portion thereof and two insert portions formed at two opposite ends thereof. One of the insert portions is inserted in the through hole 147 of the rotatable element 145, one end of the elastic element 34 is disposed around the other insert portion of the insert 38, the other end of the elastic element 34 is abutted against the adjustable element 37, and the rod element 33 is disposed through the insert 38. The elastic element 34 is not directly abutted against the rotatable element 145, which can prevent damage to the rotatable element 145.

One end of the pedal 40 is swingably coupled to a distal end (in this embodiment) of the bottom plate 11, and the other end of the pedal 40 is co-movably connected to the axle 20. As the pedal 40 swings, the axle 20 is driven by the pedal 40 to rotate around the axis 21 and the linking assembly 30 is co-movably driven simultaneously to swing.

Figure 3:
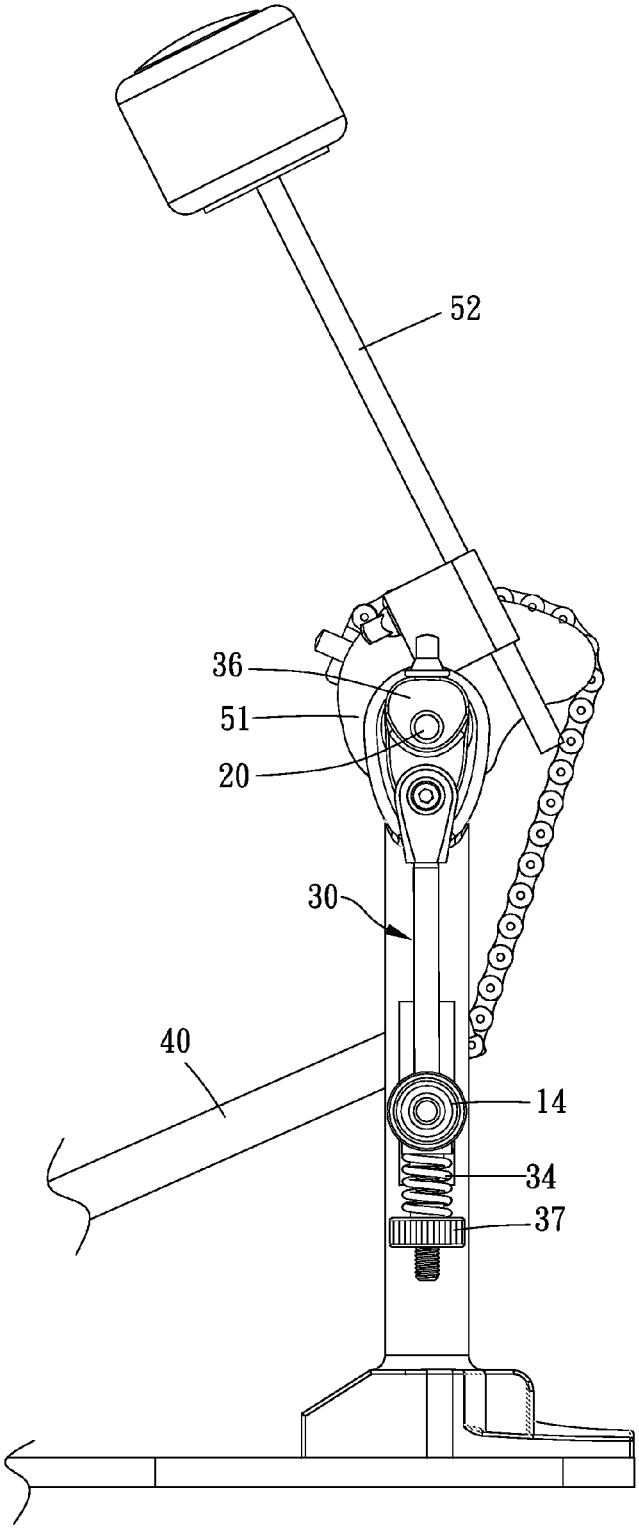
FIG. 3 is a partial side view of the first embodiment of the present invention.
Figure 4:
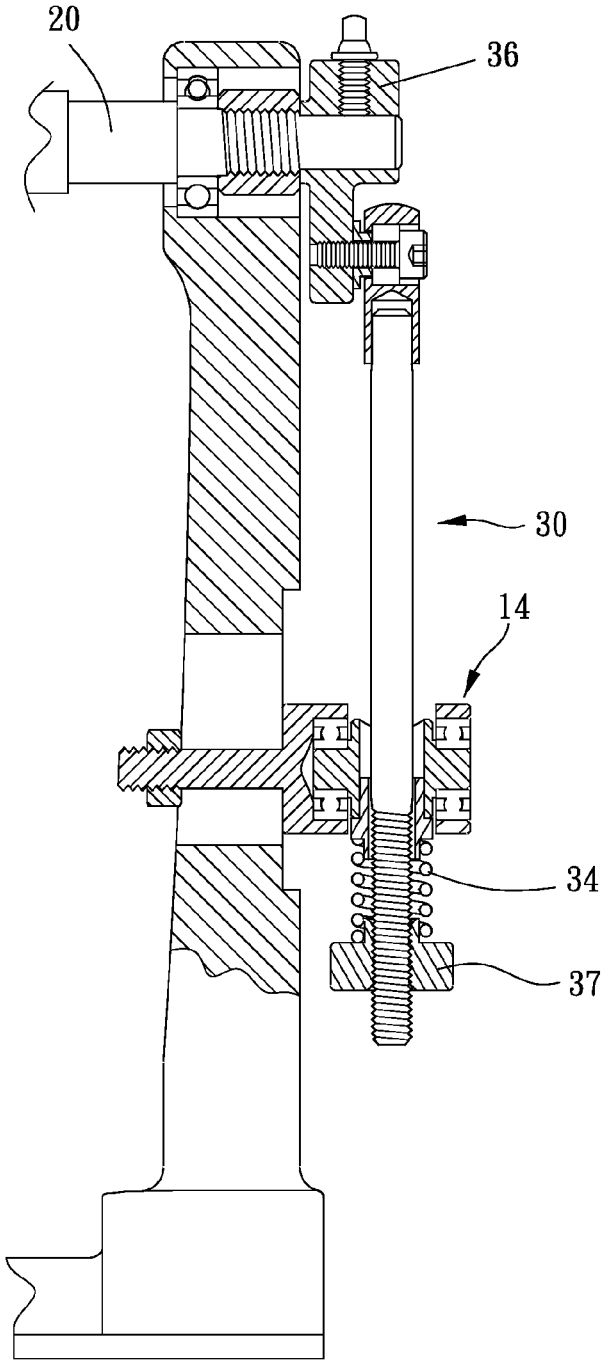
FIG. 4 is a partial cross-sectional view of the first embodiment of the present invention.
Figure 5:
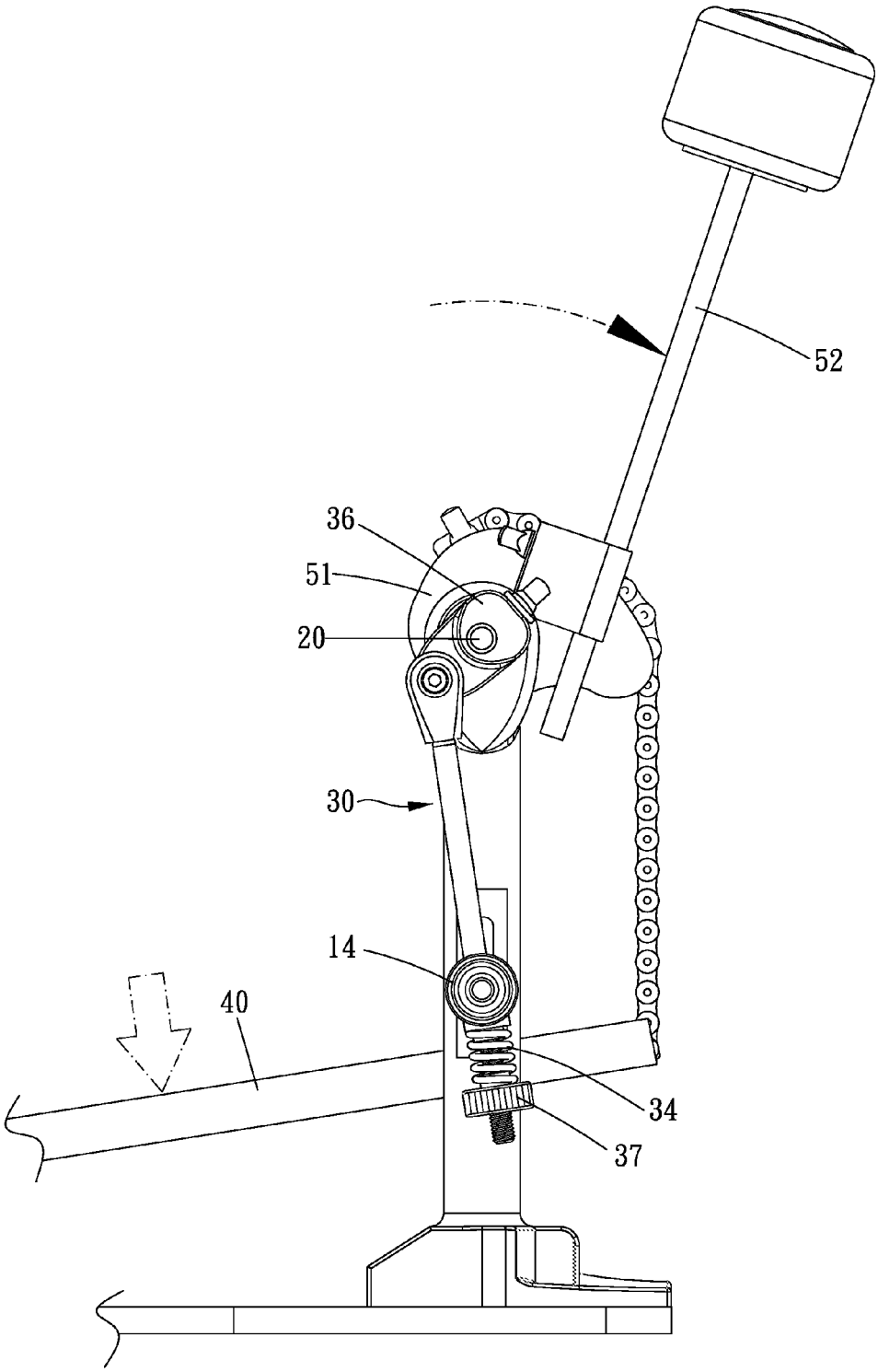
FIG. 5 is a drawing showing a drum beating apparatus in use according to the first embodiment of the present invention.

In this embodiment, a beating assembly 50 is coupled substantially radially to the axle 20 and between the first post 12 and the second post 13. The beating assembly 50 includes a connecting body 51 fixed to a circumferential surface of the axle 20 and a drumstick 52 connected to the connecting body 51. The drumstick 52 is substantially perpendicular to the axle 20 and extends in a direction which is away from the axle 20. The pedal 40 is connected to and cooperated with the connecting body 51 via a chain device, for example, so that the axle 20 can be rotated by the chain device by treading the pedal 40 downwardly, and the linking assembly 30 and the drumstick 52 are co-movably driven to swing in opposite ways (counterclockwise and clockwise) simultaneously (as shown in FIG. 5), and thus the swinging drumstick 52 can beat, for example, on a drum. As the pedal 40 is treaded, the connecting element 22 rotates around the axis 21 and pulls the rod element 33 slantly upwardly. As such, the elastic element 34 is depressed to generate a biasing potential energy, the depressed elastic element 34 urges the adjustable element 37 at the second end 32 toward the bottom plate 11 when the pedal 40 is released, so that the linking assembly 30, the pedal 40 and the beating assembly 50 can return to the original position (as shown in FIG. 3).

Figure 6:
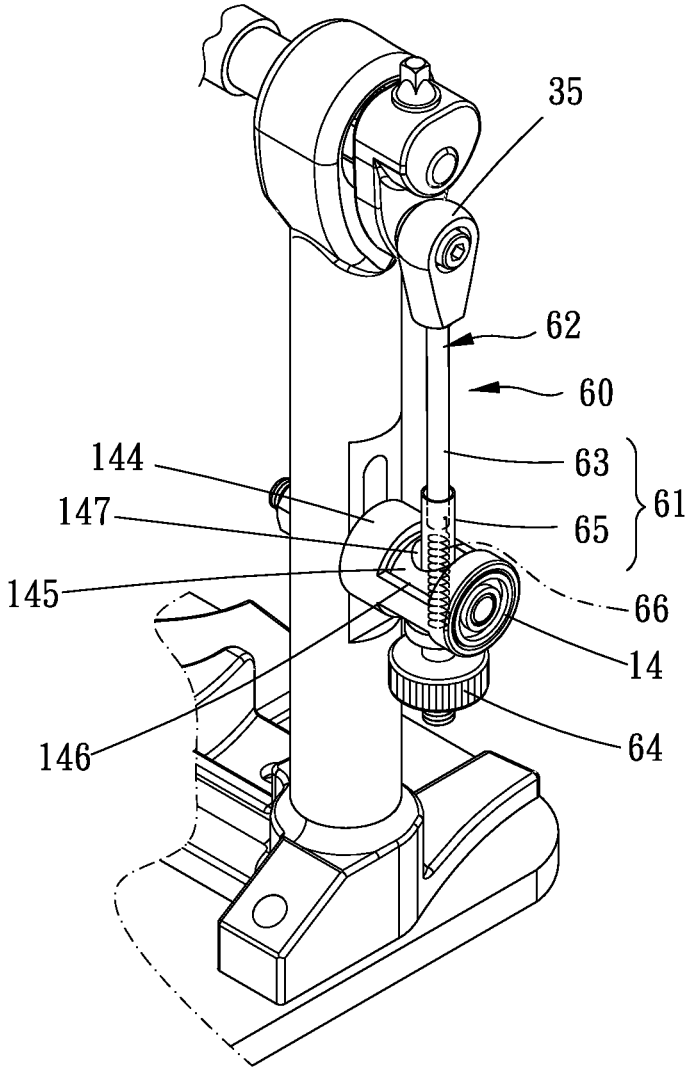
FIG. 6 is a partial perspective view of a second embodiment of the present invention.

Compared to the first embodiment, in a drum beating apparatus according to a second embodiment as shown in FIG. 6, a rod element 61 of a linking assembly 60 may radially retractable, and more specifically, the rod element 61 includes a first rod body 63 connected to a first end 62 of the linking assembly 60 and a second rod body 65 connected to a second end 64 of the linking assembly 60, In this embodiment, one end of the first rod body 63 is coupled to the first end 62 via the head portion 35. The first rod body 63 and the second rod body 65 are relatively radially movable and substantially unbendable and swingable relatively. For example, the second rod body 65 is (not limited to be) disposed around the first rod body 63, and the second rod body 65 is disposed through the connecting portion 14. An elastic element 66 is disposed in the second rod body 65, and connected to the first rod body 63 and the second rod body 65. However, according to one of various connection relationships of the first rod body 63 and the second rod body 65, for example the first rod body 63 is disposed around the second rod body 65, the elastic element 66 may be disposed in the first rod body 63. A circumferential dimension of each opening 146 of the cannular portion 144 is greater than a radial dimension of the second rod body 65, and the second rod body 65 is disposed through the two openings 146 and the through hole 147 of the rotatable element 145.

Whereby, the pedal and the beating assembly 60 can be co-movably driven simultaneously to swing in opposite ways to beat a drum as the pedal is depressed; and the linking assembly 60, the pedal and the beating assembly can return to the original position.

Given the above, in the drum beating apparatus of the present invention, since a linking assembly which is substantially unbendable is disposed between the axle and the connecting portion, the problem of oscillation or sway for a long period due to the element inertia after the beat of the drumstick can be effectively improved. As such, the operation and movement of the drumstick are much more stable, smooth and precise; and since the linking assembly is detachable, it is easy to assemble, disassemble, change and store.

Additionally, since the connecting portion is adjustable, the pedal can be adjusted to be hard or easy to be depressed as required; and since the connecting portion may be detachable, it is easy to assemble, disassemble, change and store.

Furthermore, since the first post or/and the second post are adjustable relative to the bottom plate, they can be selectively arranged in required positions according to various sizes of soles, and thus obtaining a good control effect; and since the first post or/and the second post are detachable relative to the bottom plate, it is easy to assemble, disassemble, change and store.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A drum beating apparatus, including:

a base, including a bottom plate and a first post substantially axially disposed on the bottom plate, a connecting portion being arranged radially on the first post;

an axle, coupled to the first post and rotatable around an axis of the axle;

a linking assembly, having corresponding first and second ends, a rod element which is connected between the first and second ends and an elastic element, the first end pivoted to one end of the axle, the rod element disposed through the connecting portion, the connecting portion being located between the first end and the second end, the elastic element disposed around the rod element and located between the second end and the connecting portion;

a pedal, one end thereof swingably coupled to one end of the bottom plate, the other end of the pedal co-movably connected to the axle;

wherein as the pedal swings, the axle is driven by the pedal to rotate around the axis and the linking assembly is co-movably driven simultaneously to swing.

2. The drum beating apparatus of claim 1, wherein the connecting portion is radially adjustably disposed on the first post.

3. The drum beating apparatus of claim 2, wherein a circumferential surface of the first post has a radially-extending first abutted region, the first abutted region is formed with a radially-extending through slot, the connecting portion has a second abutted region corresponding to the first abutted region, a rod portion extending from the second abutted region and a first fixation element, the rod portion is disposed through the through slot, the first fixation element is releasably coupled to a distal end of the rod portion, and the second abutted region is abutted against the first abutted region.

4. The drum beating apparatus of claim 1, wherein the connecting portion includes a cannular portion and a rotatable element rotatably disposed in the cannular portion, a sidewall of the cannular portion is formed with two corresponding openings, a circumferential dimension of each opening of the cannular portion is greater than a radial dimension of the rod element, the rotatable element is formed with a through hole, and the rod element is disposed through the two openings and the through hole.

5. The drum beating apparatus of claim 1, wherein the linking assembly further includes an adjustable element adjustably disposed at the second end, and the elastic element is located between the adjustable element and the connecting portion.

6. The drum beating apparatus of claim 5, wherein the linking assembly further includes an insert located between the elastic element and the connecting portion.

7. The drum beating apparatus of claim 1, wherein a connecting element is detachably coupled to the end of the axle, the connecting element and the axle are in a rotational cooperative relationship, and the first end is pivoted to the connecting element.

8. The drum beating apparatus of claim 7, wherein the connecting element includes a bore disposed around the axle and a penetrating hole communicated with the bore, a second fixation element is disposed through the penetrating hole and releasably abutted against the axle so that the connecting element is fixed to the axle.

9. The drum beating apparatus of claim 8, wherein the linking assembly further includes a head portion coupled to one end of the rod element and a pivoting assembly for the pivot of the head portion to the connecting element, and the pivoting assembly is detachably pivoted to the connecting element and the head portion.

10. The drum beating apparatus of claim 1, wherein the first post is adjustable relative to the bottom plate.

11. The drum beating apparatus of claim 1, wherein a second post corresponding to the first post base is substantially axially disposed on the bottom plate, and the axle is pivoted to the first post and the second post.

* * * * *